US010584290B2

(12) United States Patent
Pradeep et al.

(10) Patent No.: US 10,584,290 B2
(45) Date of Patent: Mar. 10, 2020

(54) PROCESS FOR CONVERSION OF RESIDUE EMPLOYING DE-ASPHALTING AND DELAYED COKING

(71) Applicant: Indian Oil Corporation Limited, Mumbai (IN)

(72) Inventors: Ponoly Ramachandran Pradeep, Faridabad (IN); Satyen Kumar Das, Faridabad (IN); Terapalli Hari Venkata Devi Prasad, Faridabad (IN); Arjun Kumar Kottakuna, Faridabad (IN); Debasis Bhattacharyya, Faridabad (IN); Sanjiv Kumar Mazumdar, Faridabad (IN); Sankara Sri Venkata Ramakumar, Faridabad (IN)

(73) Assignee: Indian Oil Corporation Limited, Mumbai (IN)

( * ) Notice: Subject to any disclaimer, the term of this patent is extended or adjusted under 35 U.S.C. 154(b) by 66 days.

(21) Appl. No.: 15/913,401

(22) Filed: Mar. 6, 2018

(65) Prior Publication Data

US 2019/0055481 A1 Feb. 21, 2019

(30) Foreign Application Priority Data

Aug. 17, 2017 (IN) ..... 201721029118

(51) Int. Cl.
*C10G 55/04* (2006.01)
*C10B 55/00* (2006.01)
(Continued)

(52) U.S. Cl.
CPC ..... *C10G 55/04* (2013.01); *C10B 55/00* (2013.01); *C10B 57/08* (2013.01); *C10G 9/005* (2013.01);
(Continued)

(58) Field of Classification Search
CPC ..... C10G 55/04; C10G 21/003; C10G 9/005; C10G 2300/1077; C10G 2300/206; C10B 55/00; C10B 57/08
See application file for complete search history.

(56) References Cited

U.S. PATENT DOCUMENTS 2,729,589 A 1/1956 Waghorne et al.
3,617,481 A 11/1971 Voorhies, Jr. et al.
(Continued)

*Primary Examiner* — Randy Boyer
*Assistant Examiner* — Juan C Valencia
(74) *Attorney, Agent, or Firm* — Melissa M. Hayworth; E. Joseph Gess

(57) ABSTRACT

The present invention relates to resid processing, particularly related to conversion of resid material with maximum recovery of lighter hydrocarbons. The invented process utilizes a novel scheme for integration of solvent de-asphalting and delayed coking processes to maximize the residue conversion to valuable products, with cleaner quality of middle distillates and fuel oil products, in comparison with other integrated solvent de-asphalting and delayed coking schemes. This process also has an additional flexibility to vary the recycle quantity, without impacting fractionator operation of the delayed coking section, which further enhances the product recovery and achieves maximum conversion of the resid feedstock, with minimum impact on liquid product properties.

15 Claims, 2 Drawing Sheets

Schematic diagram of process of present invention

(51) Int. Cl.
*C10B 57/08* (2006.01)
*C10G 21/00* (2006.01)
*C10G 9/00* (2006.01)

(52) U.S. Cl.
CPC ... *C10G 21/003* (2013.01); *C10G 2300/1077* (2013.01); *C10G 2300/206* (2013.01)

(56) References Cited

U.S. PATENT DOCUMENTS

| | | | | |
|---|---|---|---|---|
| 3,627,675 | A | 12/1971 | Ditman et al. | |
| 3,975,396 | A | 8/1976 | Bushnell et al. | |
| 4,191,639 | A | 3/1980 | Audeh et al. | |
| 4,502,944 | A | 3/1985 | Nelson | |
| 4,747,936 | A | 5/1988 | Penning | |
| 6,673,234 | B2 | 1/2004 | Li et al. | |
| 9,296,959 | B2 | 3/2016 | Gillis | |
| 2009/0266742 | A1* | 10/2009 | Newman | C10B 57/045 208/131 |
| 2013/0240407 | A1* | 9/2013 | Gillis | C10G 55/04 208/86 |
| 2016/0010005 | A1* | 1/2016 | Koseoglu | C10B 57/045 208/45 |
| 2017/0029720 | A1 | 2/2017 | Koseoglu | |
| 2017/0306239 | A1* | 10/2017 | Koseoglu | C01B 32/05 |

* cited by examiner

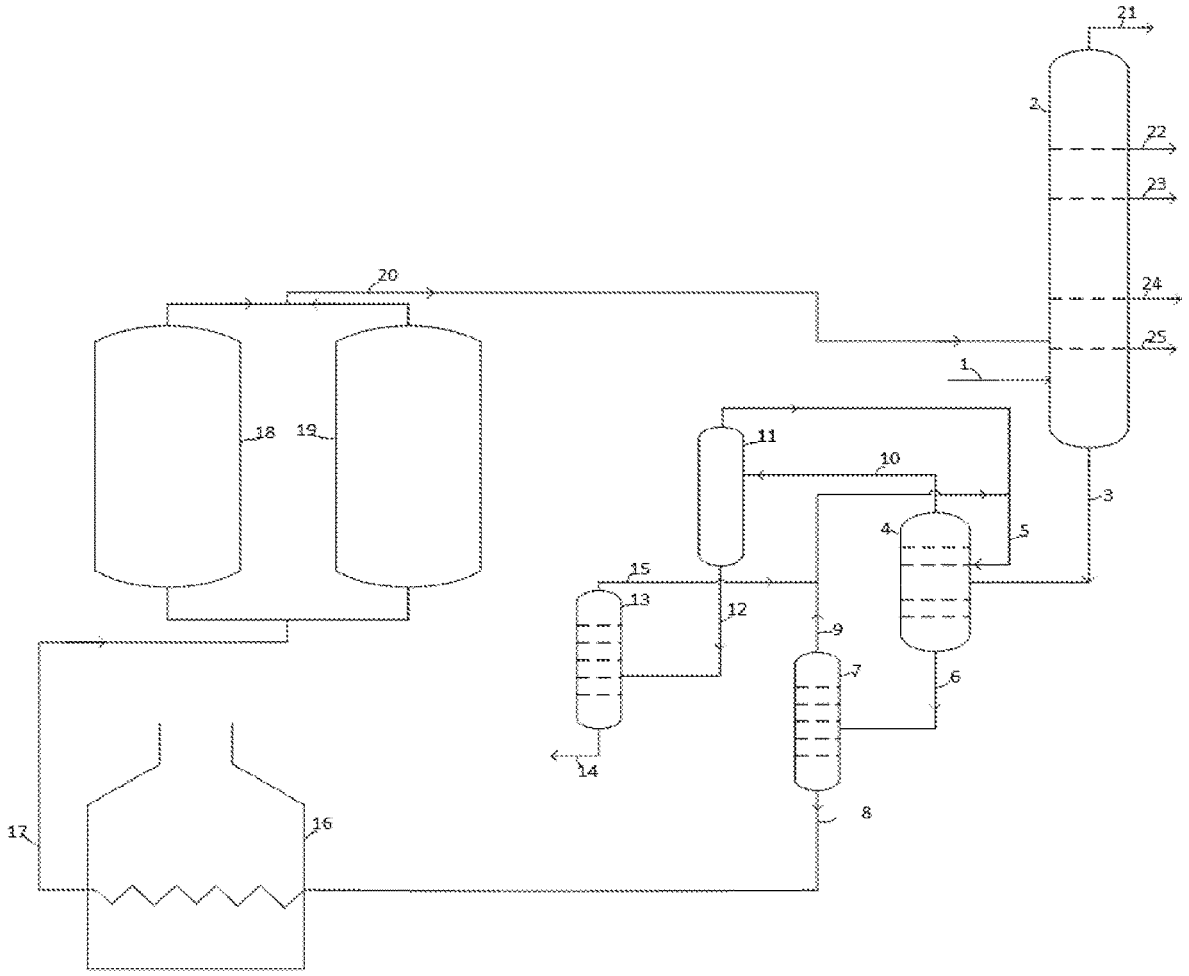
Fig. 1 Schematic diagram of the process scheme of present invention

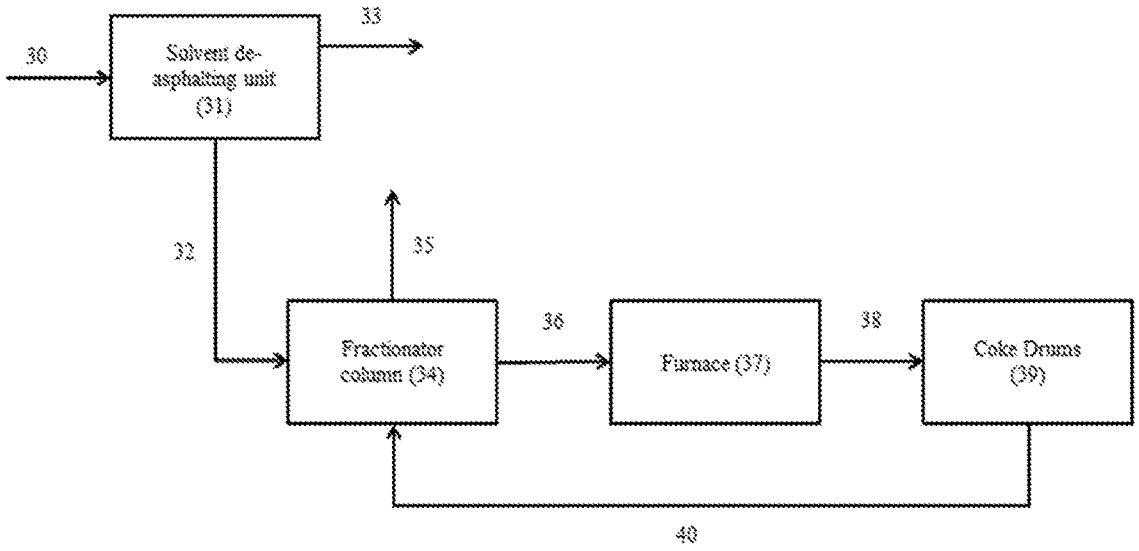
Fig. 2 Schematic diagram of conventional mode of integration of solvent de-asphalting with delayed coker unit
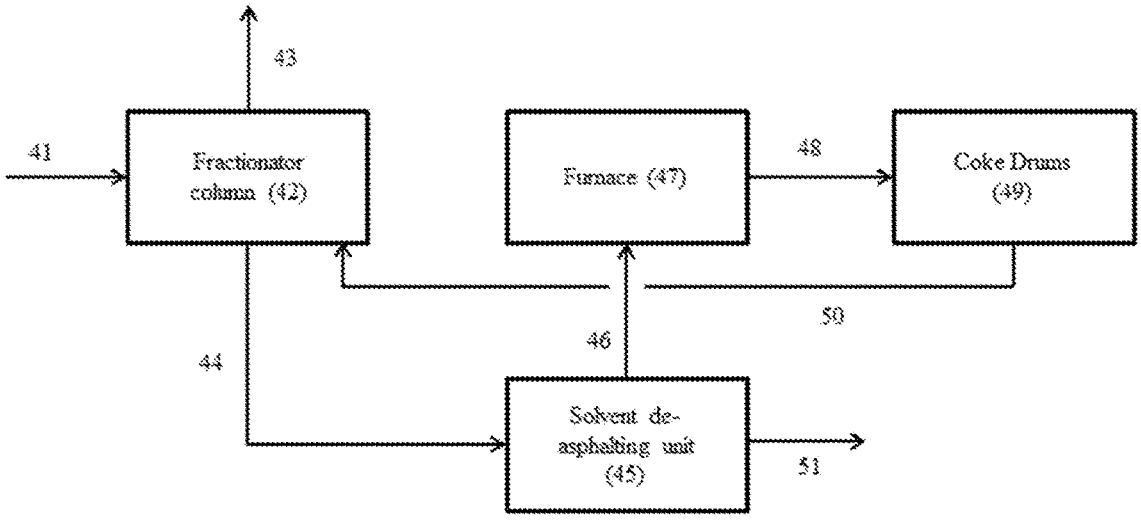
Fig. 3 Schematic diagram of process of present invention

PROCESS FOR CONVERSION OF RESIDUE EMPLOYING DE-ASPHALTING AND DELAYED COKING

RELATED APPLICATIONS

The present application claims priority to Indian Application No. 201721029118 filed Aug. 17, 2017, the contents of which are incorporated herein by reference in their entirety.

FIELD OF THE INVENTION

This invention relates to processing of heavy bottom residue material from the refining of crude oil. More specifically, this invention relates to integration of solvent de-asphalting process and delayed coking process.

BACKGROUND OF THE INVENTION

Solvent de-asphalting is a process that separates heavy hydrocarbon oil into two phases, an asphalt phase, which contains substances of relatively low hydrogen to carbon ratio often called asphaltene type materials and a de-asphalted oil phase, which contains paraffinic type material substances of relatively high hydrogen to carbon ratio often called De-asphalted Oil (DAO). Therefore, it may be said that solvent de-asphalting is possible because different compounds have different solution affinity for each other and some combination are completely miscible while other combinations are almost immiscible. The ability of the solvent to distinguish between high carbon to hydrogen asphaltene type and low carbon to hydrogen paraffinic type materials is termed as selectivity.

Solvent de-asphalting of heavy residual hydrocarbon oils using solvents to remove contaminants such as asphaltenes, metals and sulphur constituents has long been a standard processing practice in the petroleum refining industry. In the era of high crude oil prices, refiners prefer to process cheaper heavier crude. The large residue generated from heavy crude can be upgraded through solvent de-asphalting process to produce DAO for secondary processes.

Solvent de-asphalting of short residue is primarily being employed for (lube-oil base stocks) LOBS production. However, the process also employed to produce more feedstock for secondary conversion processes such as Fluid Catalytic Cracking (FCC) and hydrocracking so as to upgrade bottom of the barrel and improve distillate yield. Conventionally, Propane de-asphalting is predominantly used for production of LOBS feedstock and slightly heavier paraffinic solvents are used for production of feedstock for conversion process. Propane de-asphalting produces high quality DAO suitable for LOBS production with limited DAO yield while use of heavier solvent say, $C_5$ hydrocarbons results in increased DAO yield at the cost of quality. Thus, the choice of solvent for de-asphalting is made based on the requirement of DAO yield and rejection level of contaminants leading to requirement of two different processing units.

The use of light hydrocarbon to upgrade heavy hydrocarbon oils is the subject of many patents, for instance U.S. Pat. Nos. 4,502,944, 4,747,936, 4,191,639 3,975,396, 3,627,675, and 2,729,589. Use of mixture of propane, $CO_2$, $H_2S$ is reported in U.S. Pat. No. 4,191,639 and an increase in DAO yield for same quality is also reported.

Delayed coking is a process used in petroleum refineries to crack petroleum residue, thus converting it into gaseous and liquid product streams and leaving behind solid, carbonaceous petroleum coke. The excess generation of low value petroleum coke in Delayed coking unit causes problems of coke handling and also reduces the profitability. In order to improve the conversion of the heavy residue feedstock, different process configurations employing combination of delayed coking and solvent de-asphalting processes have been employed in the prior art.

U.S. Pat. No. 3,617,481 discloses a combination of De-asphalting-Coking-Hydrotreating processes. The residue feed is first de-asphalted in a de-asphalting extractor and then the asphalt pitch is coked to obtain residual coke, by directly routing to the coking reactor. The metal containing coke is gasified in a gasifier in presence of steam and the said activated coke is employed for hydrotreating.

U.S. Pat. No. 6,673,234 describes a combination of low degree solvent asphalting and delayed coking process. In the first step, a low degree solvent de-asphalting is employed to remove the heavy asphaltene portion of the residue feedstock, in which the yield of de-asphalted oil ranges from 70 to 95 wt % of residue feedstock. In the second step, the de-asphalted oil containing lesser asphaltenes compared to the residue feedstock, along with an optional residue feed, is fed to the delayed coking section of the process. The main objective of the process is to produce premium quality petroleum coke from the residue feedstock.

U.S. Pat. No. 9,296,959 describes the integration of solvent de-asphalting with resid hydroprocessing and delayed coking. First step of this process consist of solvent de-asphalting of residue feedstock to obtain three fractions namely, de-asphalted oil, resin and pitch. The resin steam is subjected to hydrotreating, in which lighter hydrocarbons are generated and recovered. The hydrotreated resin and pitch combine together and is sent to the delayed coking section. In an embodiment, the hydrotreated resin stream is further subjected to solvent extraction to recover lighter material, before being sent to the delayed coking section.

U.S Pat. Application No. 2017/0029720 describes an enhanced solvent de-asphalting delayed coking integrated process, where the de-asphalted oil is routed to the delayed coker unit for coking. In an embodiment, the solvent de-asphalting is carried out in presence of an adsorbent material for removal of poly nuclear aromatics, sulfur and nitrogen compounds.

It is seen that different schemes have been described in the art wherein a combination of solvent de-asphalting and delayed coking processes. But, in none of the schemes, the issue of recycle fraction removal from delayed coking feed is addressed. In the case where pitch after de-asphalting of vacuum residue is routed directly to delayed coker fractionator bottom, the recycle fraction will mix with the pitch. This pitch with recycle fraction when subjected to delayed coking in coke drums, product yield pattern deteriorates in terms of higher coke yield. In case where the fractionator is made to operate at zero recycle, where condensation of heavy material from product vapors entering the fractionator is avoided, the quality of heavier products like Heavy Coker Gas Oil (HCGO) and Coker Fuel Oil (CFO) deteriorates in terms of increasing density, CCR and asphaltene content, impacting the downstream unit operations like hydrocracker. In view of this it is beneficial to have a process scheme in which the quality of HCGO and CFO is not compromised while reducing recycle ratio in an integrated solvent de-asphalting-delayed coking process scheme.

SUMMARY OF THE INVENTION

This summary is provided to introduce a selection of concepts in a simplified format that are further described in the detailed description of the invention. This summary is not intended to identify key or essential inventive concepts of the claimed subject matter, nor is it intended for determining the scope of the claimed subject matter.

The present invention as embodied and broadly described herein discloses an integrated coking and solvent de-asphalting process, the process comprising introducing of a feedstock near to bottom of a fractionator column to obtain a mixed feed drawn out from the bottom of the fractionator column, contacting the mixed feed with a solvent in a extractor to obtain a pitch stream containing asphaltenic fraction and predominantly a paraffinic stream containing a de-asphalted oil and the solvent, passing the pitch stream to a pitch solvent stripper to obtain a residual pitch stream and the solvent, heating the residual pitch stream in a furnace to a coking temperature to obtain a hot pitch stream, transferring the hot pitch stream to one of a plurality of coke drums where it undergoes thermal cracking reaction to obtain hydrocarbon vapours and coke, passing the hydrocarbon vapours to the fractionator column to obtain product fraction.

In integrated solvent de-asphalting-delayed coking process scheme as described herein quality of HCGO and CFO is not compromised while reducing recycle ratio. Accordingly, the process of present invention results in higher yield and better quality of desired products.

OBJECT OF THE INVENTION

The main object of the present invention is to provide an improved and flexible de-asphalting process for the processing of heavy bottom residue material from the refining of crude oil.

Another object of the invention, in particular, relates to Delayed Coking process, a process used in petroleum refineries to crack petroleum residue, thus converting it into gaseous and liquid product streams and leaving behind solid, carbonaceous petroleum coke.

Still another object of the invention is to provide a solvent de-asphalting process, in which the residue feedstock such as reduced crude oil or vacuum residue is mixed with lighter solvents to remove the asphaltene rich phase from the feedstock.

BRIEF DESCRIPTION OF THE DRAWINGS

The aforementioned aspects and other features of the present invention will be explained in the following description, taken in conjunction with the accompanying drawings, wherein:

FIG. 1 illustrates the schematic diagram of the process scheme of present invention.

FIG. 2 illustrates the schematic diagram of conventional mode of integration of solvent de-asphalting with delayed coker unit.

FIG. 3 illustrates schematic diagram of process of present invention.

DESCRIPTION OF THE INVENTION

It should be understood at the outset that although illustrative implementations of the embodiments of the present disclosure are illustrated below, the present invention may be implemented using any number of techniques, whether currently known or in existence. The present disclosure should in no way be limited to the illustrative implementations, and techniques illustrated below, but may be modified within the scope of the appended claims along with their full scope of equivalents.

The terminology and structure employed herein is for describing, teaching and illuminating some embodiments and their specific features and elements and does not limit, restrict or reduce the scope of the claims or their equivalents.

Reference throughout this specification to "an aspect", "another aspect" or similar language means that a particular feature, structure, or characteristic described in connection with the embodiment is included in at least one embodiment of the present invention. Thus, appearances of the phrase "in an embodiment", "in another embodiment" and similar language throughout this specification may, but do not necessarily, all refer to the same embodiment.

The terms "comprises", "comprising", or any other variations thereof, are intended to cover a non-exclusive inclusion, such that a process or method that comprises a list of steps does not include only those steps but may include other steps not expressly listed or inherent to such process or method.

Unless otherwise defined, all technical and scientific terms used herein have the same meaning as commonly understood by one of ordinary skilled in the art to which this invention belongs. The system, methods, and examples provided herein are illustrative only and not intended to be limiting. Embodiments of the present invention will be described below in detail with reference to the accompanying drawings.

Any particular and all details set forth herein are used in the context of some embodiments and therefore should NOT be necessarily taken as limiting factors to the attached claims. The attached claims and their legal equivalents can be realized in the context of embodiments other than the ones used as illustrative examples in the description below.

In an embodiment, an integrated coking and solvent de-asphalting process, the said process comprises introduction of a feedstock [1] near to bottom of a fractionator column [2] to obtain a mixed feed [3] drawn out from the bottom of the fractionator column; contacting the mixed feed [3] with a solvent [5] in a extractor [4] to obtain a pitch stream [6] containing asphaltenic fraction and predominantly a paraffinic stream [10] containing a de-asphalted oil and the solvent; passing the pitch stream [6] to a pitch solvent stripper [7] to obtain a residual pitch stream [8] and the solvent; heating the residual pitch stream [8] in a furnace [16] to a coking temperature to obtain a hot pitch stream [17]; transferring the hot pitch stream [17] to one of a plurality of coke drums [18, 19] where it undergoes thermal cracking reaction to obtain hydrocarbon vapours [20] and coke; passing the hydrocarbon vapours [20] to the fractionator column [2] to obtain product fraction.

According to an aspect of the present subject matter, in said embodiment the mixed feed [3] comprises the feedstock [1] and an internal recycle stream in the range from 5 to 80 wt % of the feedstock.

According to an aspect of the present subject matter, in said embodiment the solvent to the mixed feed ratio in step (b) is in the range of 2:1 to 50:1.

According to an aspect of the present subject matter, in said embodiment the paraffinic stream [10] is transferred to a solvent separator [11] to obtain the solvent and the de-asphalted oil [12].

According to an aspect of the present subject matter, in said embodiment the paraffinic stream [10] further comprises a lighter paraffinic fraction of the internal recycle stream.

According to an aspect of the present subject matter, in said embodiment the solvent is recovered from the de-asphalted oil [12] in an oil solvent stripper [13] to obtain the solvent and a residual de-asphalted oil [14].

According to an aspect of the present subject matter, in said embodiment the solvent recovered from the pitch solvent stripper [7], the solvent separator [11] and the oil solvent stripper [13] is recycled to the extractor [4].

According to an aspect of the present subject matter, in said embodiment the solvent is selected from the group comprising of hydrocarbons having 3 to 7 carbon atoms and mixtures thereof.

According to an aspect of the present subject matter, in said embodiment the extractor [4] is operated at a temperature in the range of 55 to 300° C.

According to an aspect of the present subject matter, in said embodiment the extractor [4] is operated at a pressure in the range of 1 to 60 kg/cm$^2$ (g).

According to an aspect of the present subject matter, in said embodiment the coke drums [18, 19] are operated at a temperature in the range of 470 to 520° C.

According to an aspect of the present subject matter, in said embodiment the coke drums [18, 19] are operated at a pressure in the range of 0.5 to 5 Kg/cm$^2$ (g).

According to an aspect of the present subject matter, in said embodiment the residence time of the hot pitch stream [17] in the coke drums [18, 19] is in the range of 10 to 26 hours.

According to an aspect of the present subject matter, in said embodiment the feedstock [1] has conradson carbon residue content in the range of 4 to 30 wt % and density in the range of 0.95 to 1.08 g/cc.

According to an aspect of the present subject matter, in said embodiment the feedstock [1] is selected from vacuum residue, atmospheric residue, shale oil, coal tar, clarified oil, residual oil, heavy waxy distillate, foots oil, slop oil or blend of hydrocarbons.

According to an aspect of the present subject matter, in said embodiment the product fraction is offgas selected from the group consisting of LPG and naphtha [21], Kerosene [22], Light coker gas oil [23], Heavy coker gas oil [24] and Coker fuel oil [25].

The liquid hydrocarbon feedstock suitable to be used in the process disclosed herein is selected from hydrocarbon residues like reduced crude oil, vacuum tower bottoms, reduced fuel oil from the bottom of delayed coker quench column etc. The conradson carbon residue content of the feedstock can be above 4 wt %, preferably in the range of 4 wt % to 30 wt % and density can be minimum 0.95 g/cc, preferably in the range of 0.95 to 1.08 g/cc.

The solvent de-asphalting section of the process disclosed herein operates with solvent to oil ratio in the range of 2:1 to 50:1. Solvents that are suitable to be used include paraffinic hydrocarbons with carbon numbers ranging from 3 to 7. Liquefied Petroleum Gas can also be employed as a solvent for this section. Operating temperature for the extractor can vary from 55 to 300° C. and the pressure from 1 to 60 Kg/cm$^2$ (g). Solvent is recovered using supercritical operation known in the art and recycled after recovery.

The coke drums in the delayed coking section of the process disclosed herein is operated at a higher severity with desired operating temperature ranging from 470 to 520° C., preferably between 480° to 500° C. and desired operating pressure ranging from 0.5 to 5 Kg/cm$^2$ (g) preferably between 0.6 to 3 Kg/cm$^2$ (g). The residence time provided in coke drums is more than 10 hours, preferably in the range of 10 to 26 hours.

FIG. 1 illustrates an integrated coking and solvent de-asphalting process. Feedstock (1) is routed to the bottom of the fractionator column (2) where it mixes with the internal recycle fraction and is drawn out from the bottom of the fractionator column as mixed feed (3). The mixed feed is then routed to an extractor (4), where it mixes with the solvent (5) and the heavier aromatic fraction containing asphaltenes get separated out and is drawn from the bottom of the extractor as pitch stream (6). The pitch stream is then sent to a pitch solvent stripper (7) where steam stripping of the more volatile solvent takes place. The paraffinic stream from the top of the extractor containing de-asphalted oil and solvent (10) is sent to a solvent separator (11). The de-asphalted oil (12) containing minor quantity of solvent from the solvent separator is then sent to a oil solvent stripper (13) for further recovery of solvent. The recovered solvent streams (5, 9, 15) are sent back to the extractor (4). The pitch stream (8) exiting the pitch solvent stripper is sent to a furnace (16) for heating to delayed coking temperatures. The hot pitch stream (17) exiting the furnace is then routed to one of the two coke drums (18, 19) where an extended residence time is provided to the feed for completion of thermal cracking reactions. The product hydrocarbon vapours (20) exiting the coke drum are sent to the fractionator (2) for further separation into desired products. Gaseous products (21) exiting the fractionator top are routed to a gas concentration section for further separation. Liquid products like kerosene (22), Light Coker Gas Oil (LCGO) (23), Heavy Coker Gas Oil (HCGO) (24) and Coker Fuel Oil (CFO) (25) are also withdrawn from the column.

FIG. 2 illustrates conventional mode of integrated solvent de-asphalting unit with delayed coker unit; it describes an integration of solvent deasphalting with delayed coking process being done conventionally. Vacuum residue feedstock (30) is sent to a solvent deasphalting unit (31) where the deasphalted oil (33) is taken out. The pitch (32) is then sent to the fractionator column bottom (34) of the delayed coker unit. The pitch is mixed with the internal recycle fraction and the combined pitch and recycle stream (36) is sent to the furnace (37) of the delayed coker unit. The hot feed (38) exiting the furnace is then sent to the coke drums (39) for reaction. The reaction products (40) are sent to the fractionator of the delayed coker unit for further separation to desired products (35). Here, in this sort of scheme of integration, the product quality is hampered when we maximize yields because of the higher heaviness of the pitch compared to the vacuum residue feedstock in terms of carbon residue content. The heavy pitch material sent to the delayed coker unit generates heavier products compared to that from vacuum residue feedstock. This necessitates the operation of fractionator at high recycle ratio (higher internal recycle fraction to be dropped into bottom feed) in order to maintain the product quality. But, this high recycle operation causes a deterioration in the yield pattern in the delayed coker section, in terms of higher coke yield compare to low recycle operation.

FIG. 3 illustrates an embodiment of the process of present invention, the vacuum residue feedstock (41) is sent directly to the bottom of fractionator column (42) of the delayed coker unit. The fractionator is operated at high recycle ratio and the internal recycle fraction mixes with the vacuum residue feedstock and the combined feed stream (44) is sent to the solvent deasphalting unit (45). In the solvent deasphalting unit, the deasphalted oil along with the lighter hydrocarbons of the internal recycle fraction are separated out as the deasphalted oil (51). The pitch along with the heavy hydrocarbons of recycle fraction (46) is sent to the furnace (47). The hot feed stream (48) exiting the furnace is then sent to the coke drums (49) for reactions. The vapor products (50) from the reaction are sent to the fractionator column (42) for separation into desired products.

The process integrating coking and solvent de-asphalting is further exemplified by following non-limiting examples.

Example-1

Vacuum residue feedstock of properties as provided in Table-1 was taken for the study.

TABLE 1

Properties of feedstock used in this invention

| Feed Properties | Value |
|---|---|
| CCR (wt. %) | 22.05 |
| Asphaltene (wt. %) | 7.1 |
| Sulfur (wt. %) | 5.18 |
| Na (ppm) | 4 |
| Mg (ppm) | 1 |
| Ni (ppm) | 91 |
| V (ppm) | 146 |
| Fe (ppm) | 10 |
| Paraffins (wt. %) | 43.5 |
| ASTM D 2887 Distillation, (wt. %/° C.) IBP/30/50 | 514/590/608 |

In the first step, said vacuum residue feedstock is subjected to solvent de-asphalting at two solvent/oil ratios. De-asphalted Oil yield of 23 and 50 wt % were obtained from the de-asphalting process. The detail of solvent de-asphalting experiments is provided in Table-2.

TABLE 2

Solvent de-asphalting experimental data

| | Run 1 | Run 2 |
|---|---|---|
| LPG Solvent/Oil ratio (vol./vol.) | 3.5 | 4.8 |
| De-asphalting temperature, ° C. | 85 | 90 |
| CCR of VR, wt. % | 22.05 | 22.05 |
| Pitch yield, wt. % | 77 | 50 |
| Pitch CCR, wt. % | 28 | 35.2 |
| DAO yield, wt. % | 23 | 50 |
| DAO CCR, wt. % | 2.5 | 7.04 |

The pitch is then subjected to coking in batch coker experimental reactor set up. An experiment was conducted with using vacuum residue feedstock also, in the batch coker reactor for data comparison. Results of the batch coker experiments are provided in Table-3.

TABLE 3

Batch coker experimental data

| Feed | Vacuum residue | Pitch from Run-1 | Pitch from Run-2 |
|---|---|---|---|
| Coking temperature, ° C. | 486 | 486 | 486 |
| Reactor pressure, Kg/cm$^2$ (g) | 1.05 | 1.05 | 1.05 |
| Coke yield, wt % of feed | 36 | 45.35 | 49.82 |
| Δ Coke yield [VR-Pitch] (neglecting DAO coke), wt % | — | −1.08 | −11.09 |

Example-2

Another set of experiments were carried out using solvent de-asphalting employing n-pentane solvent and batch coking employing vacuum residue feedstock of Table-1. The detail of solvent de-asphalting experiments is provided in Table-4.

TABLE 4

Solvent de-asphalting experimental data

| | RUN: 1 | RUN: 2 |
|---|---|---|
| Solvent/Oil ratio (wt./wt.) | 2 | 3 |
| De-asphalting temperature, ° C. | 50 | 50 |
| Pitch yield, wt. % | 25 | 24 |
| DAO yield, wt. % | 75 | 76 |
| Pitch CCR, wt. % | 29.33 | 33.54 |
| DAO CCR, wt. % | 20.02 | 17.61 |

The pitch is then subjected to coking in batch coker experimental reactor set up. An experiment was conducted with using vacuum residue feedstock also, in the batch coker reactor for data comparison. Results of the batch coker experiments are provided in Table-5.

TABLE 5

Batch coker experimental data

| Feed | Vacuum residue | Pitch from Run-1 | Pitch from Run-2 |
|---|---|---|---|
| Coking temperature, ° C. | 486 | 486 | 486 |
| Reactor pressure, Kg/cm$^2$ (g) | 1.05 | 1.05 | 1.05 |
| Coke yield from batch coker, wt % | 36 | 47.52 | 54.34 |
| Δ Coke yield [VR-Pitch-DAO Coke as 0.8 * feed CCR], wt. % | — | −2.91 | −3.06 |

Example-3

A case is provided as Table-6 wherein the stream summary of two schemes is compared. It can be seen that in the first case, 100 MT/hr vacuum residue feed is routed to Solvent De-asphalting (SDA), from which 50 wt % of pitch and DAO are generated. Pitch is then sent to the delayed coker fractionator, where it mixes with 5 MT/hr of recycle fraction (at 10% recycle) and enters the coke drums.

In the second case, 100 MT/hr vacuum residue feedstock is routed to (Delayed Coker Unit) DCU main fractionator column, where it mixes with 10 MT/hr recycle fraction (at 10% recycle) and enters the SDA unit. The recycle fraction generally contains much lesser quantity of asphaltenes compared to the vacuum residue feedstock and therefore is recovered along with the DAO (50+10 MT/hr). The neat pitch is sent to the coke drums for delayed coking reactions, thereby achieving zero recycle operation of the delayed coking section.

TABLE 6

Stream comparison

| Vacuum residue routed to | SDA → DCU main fractionator→ Furnace→Coke drums | DCU main fractionator→ SDA→Furnace →Coke drums |
|---|---|---|
| Feed to SDA, MT/hr | 100 | 110 |
| DAO yield, MT/hr | 50 | 60 |
| Pitch yield, MT/hr | 50 | 50 |
| Pitch entering Coke drums, MT/hr | 50 | 50 |
| Recycle fraction entering Coke drums (assuming 10% recycle | 5 | 0 |

TABLE 6-continued

| Stream comparison | | |
|---|---|---|
| Vacuum residue routed to | SDA → DCU main fractionator→ Furnace→Coke drums | DCU main fractionator→ SDA→Furnace →Coke drums |
| ratio), MT/hr | | |
| Product recovered from DCU main fractionator, MT/hr | 50 | 40 |

While specific language has been used to describe the present subject matter, any limitations arising on account thereto, are not intended. As would be apparent to a person in the art, various working modifications may be made to the method in order to implement the inventive concept as taught herein. The drawings and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment.

The invention claimed is:

1. An integrated coking and solvent de-asphalting process, the process comprising:

(a) introducing a feedstock [1] near to bottom of a fractionator column [2] to obtain a mixed feed [3] drawn out from the bottom of the fractionator column, wherein the mixed feed [3] comprises the feedstock [1] and an internal recycle stream in the range from 5 to 80 wt % of the feedstock;

(b) contacting the mixed feed [3] with a solvent [5] in a extractor [4] to obtain a pitch stream [6] containing asphaltenic fraction and predominantly a paraffinic stream [10] containing a de-asphalted oil and the solvent;

(c) passing the pitch stream [6] to a pitch solvent stripper [7] to obtain a residual pitch stream [8] and the solvent;

(d) heating the residual pitch stream [8] in a furnace [16] to a coking temperature to obtain a hot pitch stream [17];

(e) transferring the hot pitch stream [17] to one of a plurality of coke drums [18, 19] where it undergoes thermal cracking reaction to obtain hydrocarbon vapours [20] and coke; and (f) passing the hydrocarbon vapours [20] to the fractionator column [2] to obtain product fraction.

2. The process as claimed in claim 1, wherein the solvent to the mixed feed ratio in step (b) is in the range of 2:1 to 50:1.

3. The process as claimed in claim 1, wherein the paraffinic stream [10] is transferred to a solvent separator [11] to obtain the solvent and the de-asphalted oil [12].

4. The process as claimed in claim 1, wherein the paraffinic stream [10] further comprises a lighter paraffinic fraction of the internal recycle stream.

5. The process as claimed in claim 3, wherein the solvent is recovered from the de-asphalted oil [12] in an oil solvent stripper [13] to obtain the solvent and a residual de-asphalted oil [14].

6. The process as claimed in claim 5, wherein the solvent recovered from the pitch solvent stripper [7], the solvent separator [11] and the oil solvent stripper [13] is recycled to the extractor [4].

7. The process as claimed in claim 1, wherein the solvent is selected from the group comprising of hydrocarbons having 3 to 7 carbon atoms and mixtures thereof.

8. The process as claimed in claim 1, wherein the extractor [4] is operated at a temperature in the range of 55 to 300° C.

9. The process as claimed in claim 1, wherein the extractor [4] is operated at a pressure in the range of 1 to 60 $kg/cm^2$ (g).

10. The process as claimed in claim 1, wherein the coke drums [18, 19] are operated at a temperature in the range of 470 to 520° C.

11. The process as claimed in claim 1, wherein the coke drums [18, 19] are operated at a pressure in the range of 0.5 to 5 $Kg/cm^2$ (g).

12. The process as claimed in claim 1, wherein residence time of the hot pitch stream [17] in the coke drums [18, 19] is in the range of 10 to 26 hours.

13. The process as claimed in claim 1, wherein the feedstock [1] has conradson carbon residue content in the range of 4 to 30 wt % and density in the range of 0.95 to 1.08 g/cc.

14. The process as claimed in claim 1, wherein the feedstock [1] is selected from vacuum residue, atmospheric residue, shale oil, coal tar, clarified oil, residual oil, heavy waxy distillate, foots oil, slop oil or blend of hydrocarbons.

15. The process as claimed in claim 1, wherein the product fraction is offgas selected from the group consisting of LPG and naphtha [21], Kerosene [22], Light coker gas oil [23], Heavy coker gas oil [24] and Coker fuel oil [25].

* * * * *